US010286647B2

(12) United States Patent
Bangel et al.

(10) Patent No.: US 10,286,647 B2
(45) Date of Patent: May 14, 2019

(54) PROCESSING UNIT AND LABEL PRINTING MACHINE HAVING THE PROCESSING UNIT

(71) Applicant: GALLUS DRUCKMASCHINEN GMBH, Langgoens-Oberkleen (DE)

(72) Inventors: Dieter Bangel, Huettenberg (DE); Thomas Demand, Wetzlar (DE); Andreas Boedeker, Langgoens (DE)

(73) Assignee: Gallus Druckmaschien GmbH, Langgoens-Oberkleen (DE)

( * ) Notice: Subject to any disclaimer, the term of this patent is extended or adjusted under 35 U.S.C. 154(b) by 71 days.

(21) Appl. No.: 15/685,727

(22) Filed: Aug. 24, 2017

(65) Prior Publication Data

US 2018/0056641 A1 Mar. 1, 2018

(30) Foreign Application Priority Data

Aug. 25, 2016 (DE) ..... 10 2016 215 986

(51) Int. Cl.

| | |
|---|---|
| ***B41K 1/36*** | (2006.01) |
| ***B41F 3/54*** | (2006.01) |
| ***B41F 13/34*** | (2006.01) |
| ***B41F 13/24*** | (2006.01) |

(Continued)

(52) U.S. Cl.

CPC ..... *B41F 3/54* (2013.01); *B41F 13/20* (2013.01); *B41F 13/21* (2013.01); *B41F 13/24* (2013.01); *B41F 13/34* (2013.01); *B41K 1/363* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,530,282 | A | 7/1985 | Schulz | |
| 4,810,179 | A * | 3/1989 | Cavanagh | B29C 43/24 264/175 |

(Continued)

FOREIGN PATENT DOCUMENTS

| | | | |
|---|---|---|---|
| DE | 3317746 | A1 | 11/1984 |
| DE | 102005015046 | A1 | 10/2006 |

(Continued)

*Primary Examiner* — David H Banh

(74) *Attorney, Agent, or Firm* — Laurence A. Greenberg; Werner H. Stemer; Ralph E. Locher

(57) ABSTRACT

A processing unit, for example a printing unit, for the rotational processing of a web-shaped or sheet-shaped substrate, includes a machine frame, at least a first processing cylinder movably mounted in the machine frame, a second processing cylinder stationarily mounted in the machine frame, and a pair of support members associated with each respective processing cylinder. Each support member of the second processing cylinder has an annular segment, a linear guide, a guide body fixed to the machine frame and a manipulator. Each annular segment contacts a respective support member of the first processing cylinder, and each annular segment is linearly displaceable along the linear guide by a respective manipulator. The processing unit permits a gap dimension between the processing cylinders of the processing unit to be adjustable in a simple, exact manner with precise repeatability. A label printing machine having the processing unit is also provided.

9 Claims, 5 Drawing Sheets

(51) Int. Cl.
*B41F 13/21* (2006.01)
*B41F 13/20* (2006.01)

(56) References Cited

U.S. PATENT DOCUMENTS 5,099,760 A * 3/1992 Schenider ..... B23Q 1/68 101/351.4
5,423,254 A * 1/1995 Kimura et al. ..... B41F 5/20 101/217
5,433,897 A * 7/1995 Kanome ..... B29C 43/222 264/1.33
6,457,407 B2 * 10/2002 Leib ..... B41F 13/30 101/145
7,754,116 B2 * 7/2010 Mizunuma ..... B29C 43/245 264/173.1
8,499,691 B2 * 8/2013 Bangel ..... B41F 11/00 101/145
2001/0003954 A1 * 6/2001 Leib ..... B41F 13/30 101/145
2002/0020314 A1 * 2/2002 Jader ..... B41F 13/32 101/216
2004/0045463 A1 * 3/2004 Pertile ..... B41F 31/027 101/350.6
2007/0045885 A1 * 3/2007 Mizunuma ..... B29C 43/245 264/40.1
2016/0185099 A1 * 6/2016 Verkuijlen ..... B41F 5/24 101/216
2016/0375679 A1 * 12/2016 Schmale ..... B41F 3/00 101/407.1
2017/0043570 A1 * 2/2017 Bastici ..... B41F 5/24
2017/0157966 A1 * 6/2017 Becker ..... B41M 1/04

FOREIGN PATENT DOCUMENTS

EP 2103429 B1 12/2012
WO 2012016758 A1 2/2012

* cited by examiner

PROCESSING UNIT AND LABEL PRINTING MACHINE HAVING THE PROCESSING UNIT

CROSS-REFERENCE TO RELATED APPLICATION

This application claims the benefit, under 35 U.S.C. §119, of German Patent Application DE 10 2016 215 986.0, filed Aug. 25, 2016; the prior application is herewith incorporated by reference in its entirety.

BACKGROUND OF THE INVENTION

Field of the Invention

The invention relates to a processing unit for the rotational processing of a web-shaped or sheet-shaped substrate. The processing unit includes at least two processing cylinders and a machine frame, in which a first processing cylinder is mounted so as to be movable in the machine frame, a second processing cylinder is mounted so as to be stationary in the machine frame, and each processing cylinder is associated with one respective pair of support members. The invention also relates to a label printing machine having such a processing unit.

Description of the Related Art

Printing units and punching units are used in label printing machines such as those described in European Patent EP 2 103 429 B1, corresponding to U.S. Pat. No. 8,499,691, for example. The printing units include at least three cylinders, specifically the inking roller, the printing roller, and the impression roller. The rotational processing therein causes ink to be applied to a substrate. The punching units include at least two cylinders, specifically the punching cylinder and the mating die cylinder. The rotational processing therein causes the incorporation of punch and/or groove lines. In order for the gap, that is to say the spacing between the cylinders, to be adapted to the substrate to be processed and in order for the punching depth to be optionally set, the gap, i.e. the spacing between the cylinders, has to be adjustable.

To that end, support members which can be configured as raceways, annular supports or so-called bearer rings are used. Examples of adjustment installations are to be found in German Publication DE 10 2005 015 046 A1 and in International Publication WO 2012/016758 A1.

On one hand, the complicated and complex construction of adjustment installations of that type is disadvantageous. On the other hand, the precision of adjustment leaves much to be desired. That also results in poor precision in repeatability. That is to say that if the very same gap dimension as in the last order has to be chosen for a repeat order, an exact adjustment of that type will be difficult to carry out.

SUMMARY OF THE INVENTION

It is accordingly an object of the invention to provide a processing unit and a label printing machine having the processing unit, which overcome the hereinafore-mentioned disadvantages of the heretofore-known devices of this general type and in which a gap dimension between processing cylinders of the processing unit is adjustable in a simple, exact manner with precise repeatability.

With the foregoing and other objects in view there is provided, in accordance with the invention, a processing unit, for example a printing unit or punching unit, for the rotational processing of a web-shaped or sheet-shaped substrate, for example for producing labels, including at least two processing cylinders and a machine frame. A first processing cylinder is mounted so as to be movable in the machine frame, a second processing cylinder is mounted so as to be stationary in the machine frame, and each processing cylinder is assigned one pair of support members.

According to the invention, a respective support member of the second processing cylinder has an annular segment, a linear guide, a guide body fixed to the frame, and a manipulator. The guide body that is fixed to the frame is attached to the machine frame of the processing unit. The manipulator acts on a respective annular segment, and a respective annular segment can be displaced in a linear manner along the linear guide by a respective manipulator. Each respective annular segment of the support member of the second processing cylinder contacts a respective support member of the first processing cylinder. This means that a respective annular segment and therewith the first processing cylinder having the support members, can be displaced by actuating the manipulator, and the spacing between the processing cylinders can be adapted due to the displacement.

In one particularly advantageous and thus preferred refinement of the processing unit according to the invention, the manipulator is configured as a rotatable eccentric roller or helical roller that is fixedly attached to the frame. The configuration as a helical roller, specifically as an involute into a circle having a constant gradient, is particularly advantageous, since a linear adjustment behavior is reached due to this configuration.

The helical roller is advantageously shaped as a respective rotatable annular or disk-shaped member in the form of a helical circle having a constant gradient. This means that the helical rollers have the form of a so-called arithmetic or Archimedean helix. The gradient of the helix is to be chosen so as to depend on the distance to be adjusted and on the desired resolution of adjustment. The use of helical rollers of this type has the advantage of enabling a linear precise adjustment behavior of the gap dimension.

In a refinement, each manipulator is assigned a controllable electric motor for rotating the respective manipulator in a motorized manner. Alternatively, however, a manual adjustment by the machine operator is also possible.

It is particularly advantageous for the support members of the first processing cylinder to be embodied as raceways that rotate conjointly with the processing cylinder. The raceways herein are disposed on the rotation axis of the processing cylinder per se.

It is considered to be particularly advantageous for the first processing cylinder to have a tensioning mechanism for setting the relative position of the processing cylinders. The tensioning mechanism herein can be embodied as a pneumatic cylinder. A corresponding tensioning mechanism can also be assigned to the further processing cylinders.

With the objects of the invention in view, there is concomitantly provided a label printing machine having at least one processing unit as described above, wherein in particular the first processing cylinder is embodied as a printing cylinder, the second processing cylinder is embodied as an impression cylinder, and a further stationary processing cylinder is embodied as an inking roller, in particular as an anilox roller. The inking roller in this instance likewise has support members as described in detail above.

By contrast, however, if the processing unit has only two processing cylinders, the processing unit can be embodied as a punching unit, wherein the first processing cylinder is embodied as a punching cylinder and the second processing cylinder is embodied as a mating die cylinder. The same construction is also suitable for an embossing unit having an embossing cylinder and a mating embossing cylinder.

The described invention and the described advantageous refinements of the invention also represent advantageous refinements of the invention in combination with one another, to the extent that these combinations are technically expedient.

Other features which are considered as characteristic for the invention are set forth in the appended claims.

Although the invention is illustrated and described herein as embodied in a processing unit and a label printing machine having the processing unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
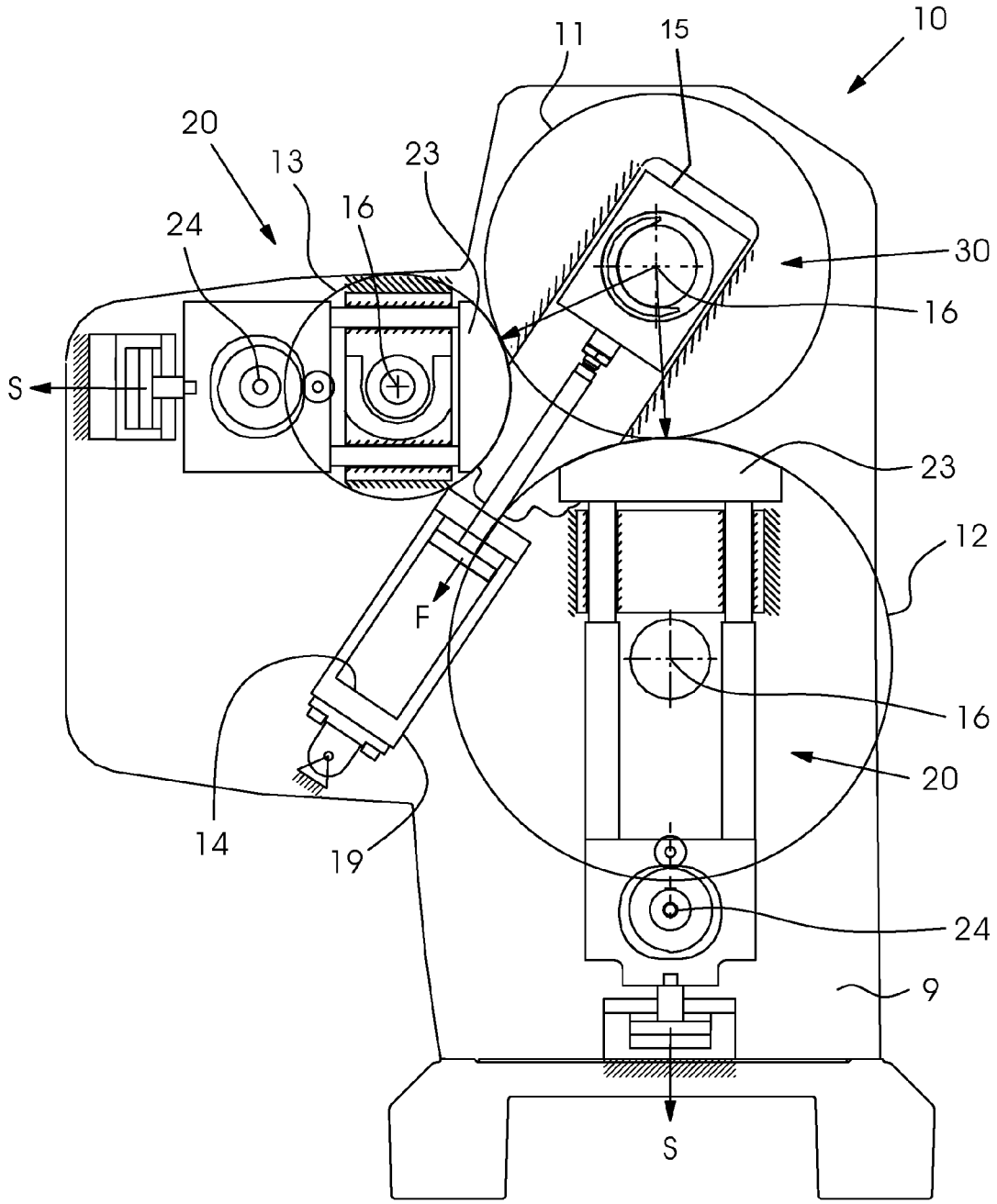
FIGS. 1 and 2 are diagrammatic, side-elevational views of a processing unit according to the invention.

Referring now in detail to the figures of the drawings, which are not true-to-scale and in which mutually equivalent elements and components are provided with the same reference signs, and first, particularly, to FIG. 1 thereof, there is seen a processing unit 10 having a first cylinder 11, a second cylinder 12, and a third cylinder 13, in which the three cylinders are mounted in a machine frame 9. The processing unit 10 in the illustrated exemplary embodiment is a flexographic printing unit, in which the first cylinder 11 is embodied as a plate cylinder, the second cylinder 12 is embodied as an impression cylinder and the third cylinder 13 is embodied as an anilox roller. The second cylinder 12 and the third cylinder 13 are mounted so as to be stationary in the machine frame 9. By contrast, the first cylinder 11 is mounted in a bearing 15 on a swing arm 19 so as to be movable in the machine frame 9. Rotation axes of the cylinders 11, 12, 13 are identified by a position marked with reference sign 16.

A pneumatic cylinder 14, which forms a tensioning mechanism, is attached to the swing arm 19. The pneumatic cylinder 14 uses a force F, which is a bias force, and serves for setting and pressing the first cylinder 11 onto the two stationary cylinders 12, 13. Support members 30, which are embodied as raceways, are disposed on the rotation axis of the first cylinder 11, so as to be axial to the first cylinder 11 and on either side thereof. The raceways contact support members 20 of the first and third cylinders 12, 13. These support members 20 each are embodied so as to be displaceable (see the arrow v in FIG. 3) in a linear manner along a linear axis 25 defining a degree of freedom as shown in FIG. 2.

Figure 2:
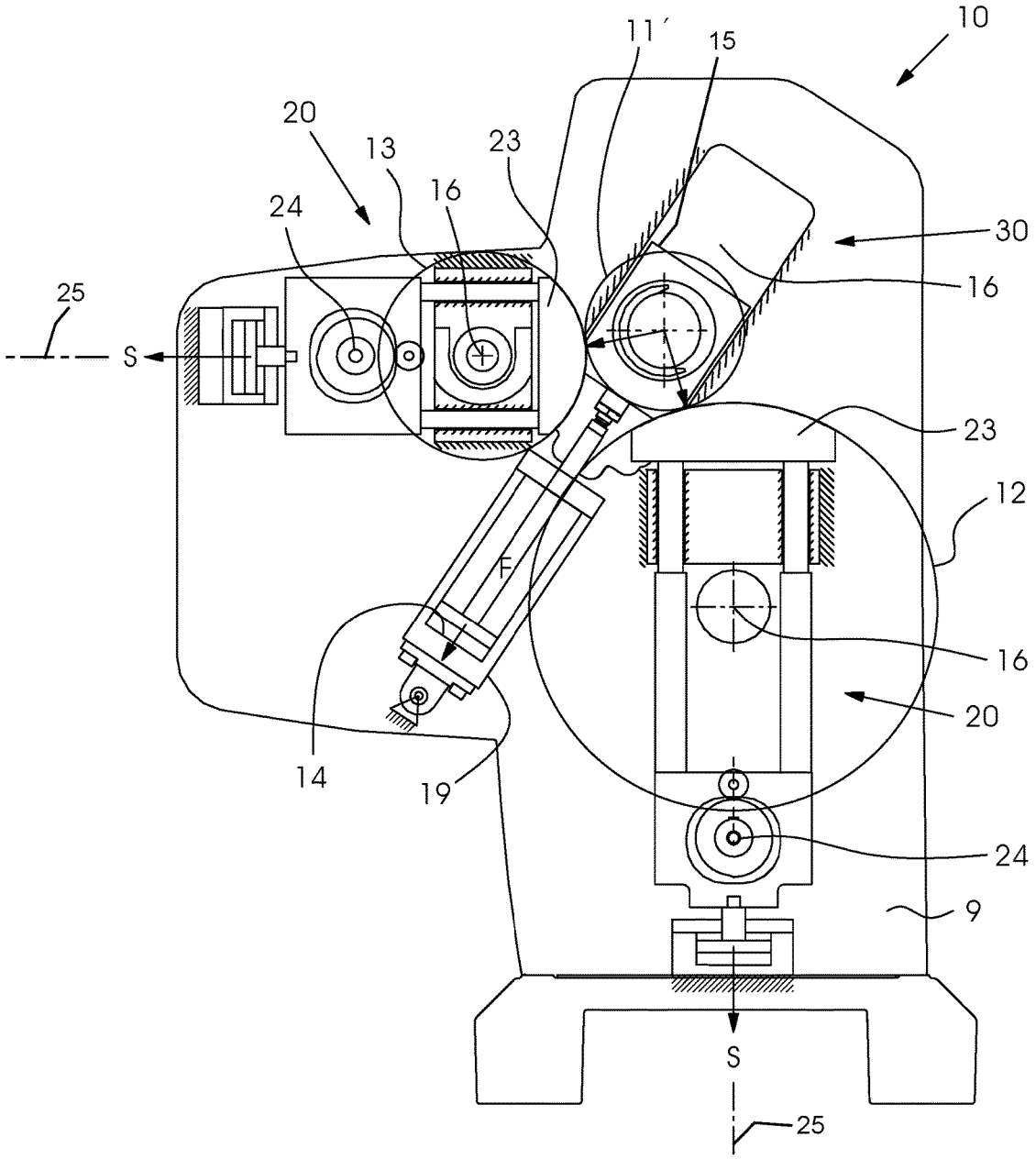

While the processing unit 10 according to FIG. 1 has a first cylinder 11 having a larger diameter, a first cylinder 11' having a smaller diameter has been fitted to the processing unit according to FIG. 2. In order for the use of cylinders 11, 11' having dissimilar diameters to be enabled, and also in order for a correction of the spacing between the cylinders 11, 12, 13 to be enabled, the bearing 15 of the first cylinder 11 is provided with an axial and lateral compensation for a correcting movement k (see also FIG. 3). The compensation may be seen from a comparison of FIGS. 1 and 2.

A tension force S can be applied and cancelled again by using the pneumatic cylinders 14 which are assigned to the cylinders 12, 13. The tension force S is applied during operation. If the cylinders 12, 13 are to be switched off, for example for cleaning purposes, the tension force S can be switched off individually by actuating the pneumatic cylinders 14 accordingly.

The pneumatic cylinder 14 that is assigned to the cylinder 11 applies the bias force F to the cylinder 11, due to which it is ensured that the raceways 30 of the latter during operation always bear on the support members 20 of the second and the third cylinders 12, 13.

Figure 3:
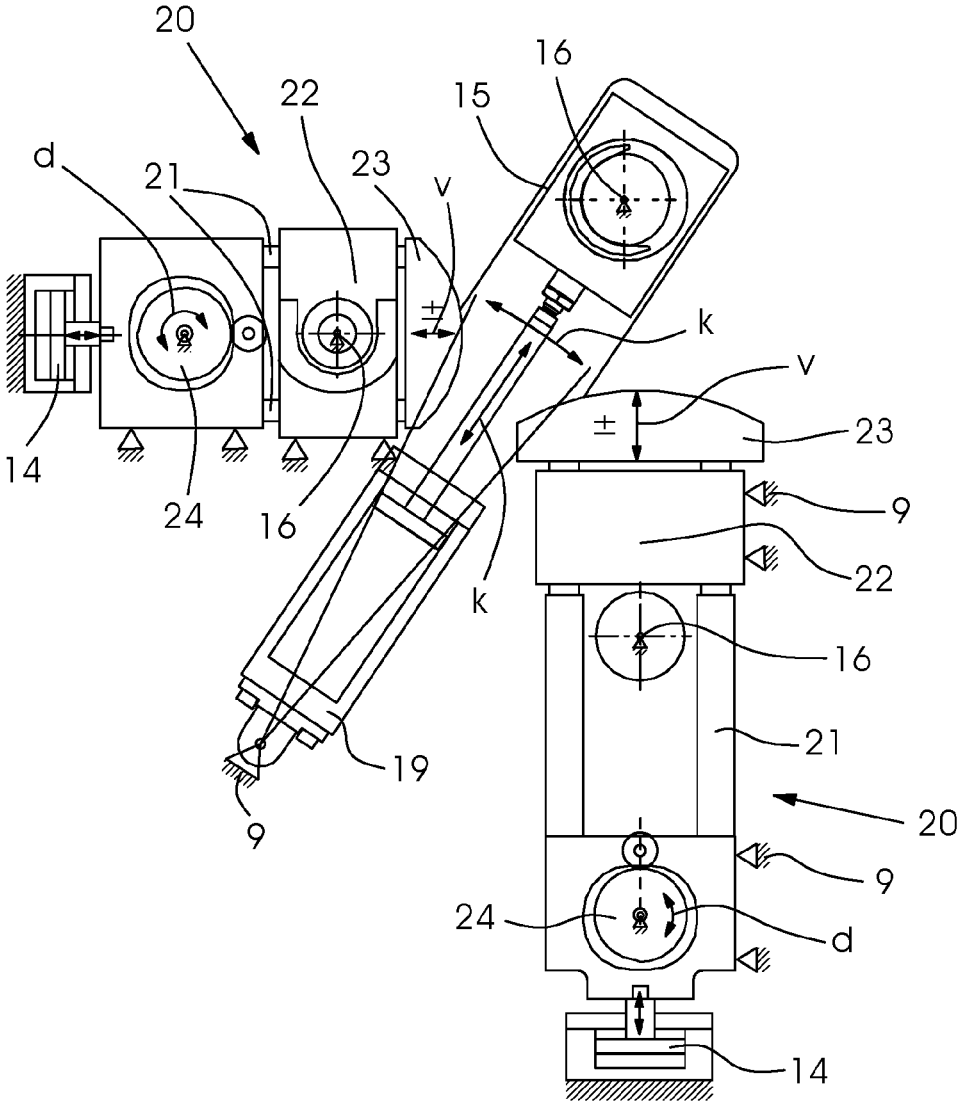
FIG. 3 is a detailed, side-elevational view of the processing unit of FIG. 1.

The construction of a respective support member 20 is shown in detail in the illustration of FIG. 3.

The support members 20 of the second cylinder 12 and of the third cylinder 13 have identical constructions. A respective support member 20 has an annular element 23 which is connected to a linear guide 21. The linear guide 21 is guided in a guide body 22 that is fixed to the frame. When activated, a rotatable manipulator 24 acts (see the double arrow d) on the linear guide 21, causes a displacing movement v of the linear guide 21 and thus a displacing movement v of the annular element 23. As has been already stated above, a pneumatic cylinder 14 which acts on the linear guide 21 is provided in order for a tension force S to be applied.

The annular element 23, which is fastened to the linear guide 21, can also be referred to as a bearer-ring segment. The guide body 22 can be embodied as a guide block that is fastened to the printing unit frame or wall 9. The manipulator 24 can be embodied as a helix having an involute into a circle, with a constant gradient.

A correction of the respective spacing between the first cylinder 11 and the second cylinder 12, or between the first cylinder 11 and the third cylinder 13, that is to say an adaptation of the so-called gap dimension between the cylinders 11, 12, 13, is performed by a targeted displacing movement v of the annular element 23 of a respective support member 20.

Figure 4:
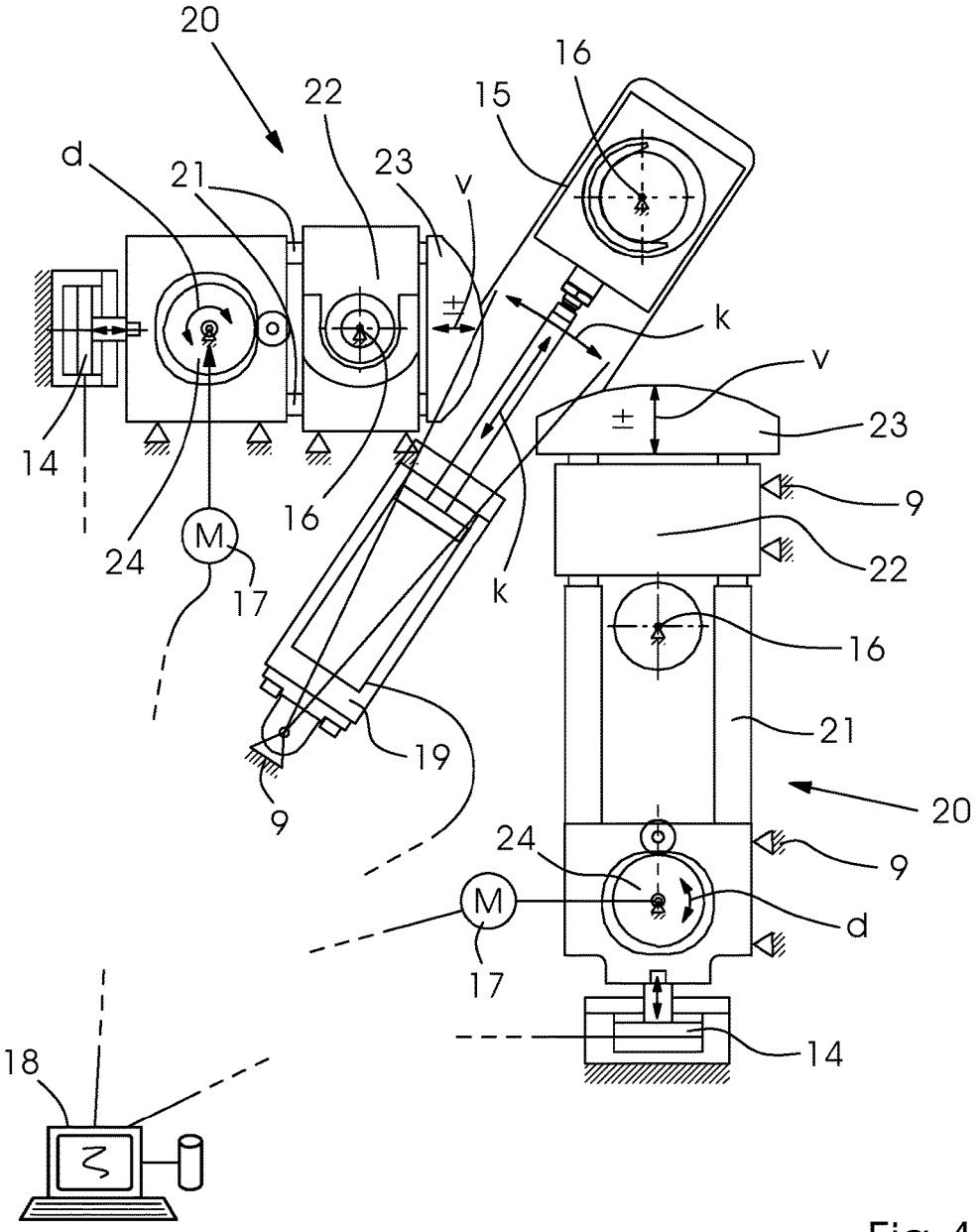
FIG. 4 is a detailed, side-elevational view of an alternative embodiment of a processing unit.

An alternative embodiment of the processing unit 10 of FIG. 3 is illustrated in FIG. 4. Each manipulator 24 in FIG. 4 has a controllable electric motor 17. The respective electric motor 17 in this instance causes a rotating movement d of the helical or eccentric body. The motors 17 and the pneumatic cylinder 14 are connected to a control installation 18 in terms of data transmission technology in such a way that at least an actuation of the motors 17 and of the pneumatic cylinders 14 is enabled by a central operator interface of the control installation 18.

Figure 5:
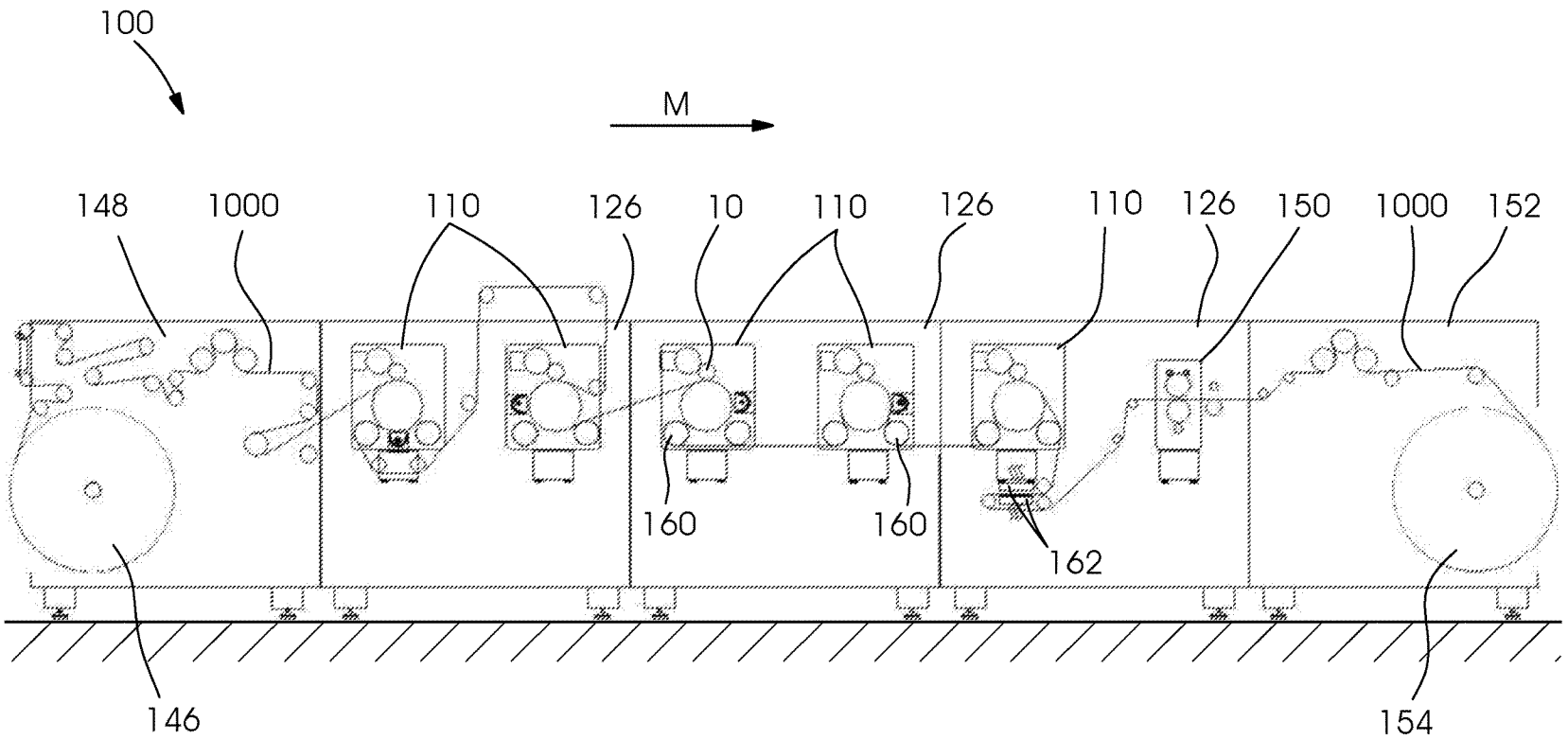
FIG. 5 is a longitudinal-sectional view of a label printing machine having a plurality of processing units.

An illustration of a preferred embodiment of a printing machine 100, more specifically a narrow-web label printing machine with a sequential construction, having printing units 110 that follow in the horizontal direction, is shown in FIG. 5. The label printing machine 100 serves for processing a substrate 1000 in the shape of a web. The substrate is unwound from a substrate roll 146 in a feed part 148 of the printing machine 100 and is guided along a path in a machine running direction M through the printing machine 100. The printing machine 100 can have a plurality of frame modules 126. Three frame modules 126 are provided in an exemplary manner in the figure. The frame modules 126 conjointly form the machine frame 9. In this embodiment, in each case two printing units 110, or one printing unit 110 and one processing unit 150, which is illustrated as a punching unit for punching the labels from the web-shaped substrate 1000, are received in each case on one frame module 126. The individual processing stations are followed by an output part 152 in which the finished products are wound onto a label roll 154. The feed part 148, the frame modules 126, and the output part 152 are respectively interconnected in a releasable or separable manner, resulting in a modular construction of the printing machine 100.

In the illustration of the individual printing units 110, which are illustrated as flexographic printing units, chamber doctor blades are also shown apart from the printing cylinders 11, the impression cylinders 12 and the inking rollers 13. The printing units 110 in the printing machine 100 furthermore have various drying installations. The printing units 110 also have web guide rollers 160 for guiding the web-shaped substrate 1000. The fifth printing unit 110 in the embodiment shown has a hot air drying installation 162. Alternatively, a UV or an IR drying installation could also be employed in this case. A punching unit 150, which has a punching cylinder 11 and a mating die cylinder 12 as rotating tools, is disposed subsequent to the drying installation. A respective embossing unit, for example a hot-film embossing unit, can also be used additionally or alternatively to the punching unit.

Gravure printing, offset printing and rotary screen printing units can also be employed as an alternative to the illustrated flexographic printing units.

In this case, at least one of the printing units 110 and/or the punching unit 150 have the construction of the processing units 10 described above.

The invention claimed is:

1. A processing unit for the rotational processing of a web-shaped or sheet-shaped substrate, the processing unit comprising:

a machine frame;

at least two processing cylinders including a first processing cylinder movably mounted in said machine frame, a second processing cylinder stationarily mounted in said machine frame, and pairs of support members each pair being associated with a respective one of said processing cylinders;

each respective support member of said second processing cylinder having an annular segment, a linear guide, a guide body fixed to said machine frame and a manipulator;

said annular segments each contacting a respective support member of said first processing cylinder; and each of said annular segments being linearly displaceable along a respective one of said linear guides by a respective one of said manipulators.

2. The processing unit according to claim 1, wherein each of said manipulators is a respective rotatable eccentric roller or helical roller fixedly attached to said machine frame.

3. The processing unit according to claim 2, which further comprises electric motors each being associated with a respective one of said manipulators for rotating said respective manipulators in a motorized manner.

4. The processing unit according to claim 1, wherein said support members of said first processing cylinder are raceways.

5. The processing unit according to claim 1, wherein said first processing cylinder has a tensioning mechanism for setting a relative position of said processing cylinders.

6. The processing unit according to claim 5, wherein said tensioning mechanism is a pneumatic cylinder.

7. A label printing machine, comprising at least one processing unit according to claim 1.

8. A label printing machine, comprising:

at least one processing unit according to claim 1;

said first processing cylinder being a printing cylinder;

said second processing cylinder being an impression cylinder; and a further stationary processing cylinder being an inking roller.

9. The label printing machine according to claim 8, wherein said inking roller is an anilox roller.

* * * * *